United States Patent [19]

Podszun et al.

[11] Patent Number: 4,719,164

[45] Date of Patent: Jan. 12, 1988

[54] LIQUID ELECTROSTATOGRAPHIC SUSPENSION DEVELOPER COMPRISES PIGMENT COATED WITH POLYCYANOACRYLATE INNER SHELL AND ADDITIONAL SHELL OF COPOLYMER

[75] Inventors: Wolfgang Podszun; Helmut Waniczek; John Goossens, all of Cologne, Fed. Rep. of Germany

[73] Assignee: Agfa Gevaert Aktiengesellschaft, Leverkusen, Fed. Rep. of Germany

[21] Appl. No.: 851,489

[22] Filed: Apr. 14, 1986

[30] Foreign Application Priority Data

Apr. 25, 1985 [DE] Fed. Rep. of Germany ..... 3514867

[51] Int. Cl.[4] ..... G03G 9/12

[52] U.S. Cl. ..... 430/114; 430/115; 428/407

[58] Field of Search ..... 430/115, 114, 113; 428/402.24, 407

[56] References Cited

U.S. PATENT DOCUMENTS

| | | | |
|---|---|---|---|
| 4,241,159 | 12/1980 | Priem et al. | 430/114 |
| 4,452,861 | 6/1984 | Okamoto et al. | 428/522 |
| 4,521,505 | 6/1985 | Podszun | 430/114 X |

*Primary Examiner*—J. David Welsh

*Attorney, Agent, or Firm*—Connolly & Hutz

[57] ABSTRACT

Improved electrostatographic suspension developers contain a pigment coated with polycyanoacrylate.

Wherein the polycyanoacrylate comprises an inner shell on a pigment dispersed in an electrically insulating carrier liquid having a volume resistance of at least $10^9$ ohm.cm and a dielectric constant below 3 and the pigment has an additional shell of a copolymer of A. cationic monomers which contain ammonium, phosphonium or sulfonium groups and of which the anions are derived from CH-acid compounds containing at least one $C_6$–$C_{24}$ hydrocarbon radical and B. radically polymerizable olefinically unsaturated compounds as comonomers.

6 Claims, No Drawings

LIQUID ELECTROSTATOGRAPHIC SUSPENSION DEVELOPER COMPRISES PIGMENT COATED WITH POLYCYANOACRYLATE INNER SHELL AND ADDITIONAL SHELL OF COPOLYMER

This invention relates to an electrostatographic suspension developer based on pigment particles coated with polycyanoacrylate and to a process for its preparation.

Electrostatic images on electrostatographic recording materials are developed by dry and wet development processes. The wet development processes are superior to the dry development processes in regard to marginal definition and resolution, particularly in color copying processes.

Suspension developers generally consist of a highly insulating carrier liquid, a pigment, a charge-determining substance (controller) and a polymer. The carrier liquid preferably has a volume resistance of at least $10^9$ ohm.cm and a dielectric constant below 3. The pigments used are, for example, standard azo dyes, xanthene dyes, phthalocyanine dyes, of the type described inter alia in DE-A No. 29 44 021. The black pigments used are primarily carbon blacks.

The principal function of the polymer is to impart adequate steric stabilization to the pigment dispersion and to guarantee adhesion or rather fixing of the pigment particles to the image support.

Numerous polymers of different structure may be used as a component of electrostatographic suspension developers. Thus, the use of random copolymers synthesized from substantially apolar monomers (for example $C_6$–$C_{20}$ alkyl(meth)acrylate) and more strongly polar monomers (for example aminomethacrylates or vinyl pyrrolidone) has been described in numerous publications (cf. for example DE-A No. 19 27 592, DE-A No. 19 38 001, BE-A No. 784 367, JP-A No. 49 129 539 or JP-A No. 73 431 54). Styrene-butadiene copolymers may also be used (cf. for example DE-A No. 23 37 419, DE-A No. 24 52 499 or JP-A No. 73 290 72).

Various graft copolymers have also been used in the synthesis of suspension developers (cf. for example DE-A No. 20 42 804, DE-A No. 21 03 045, DE-A No. 24 21 037, DE-A No. 25 32 281, DE-A No. 24 32 288, DE-A No. 29 35 287, GB-A No. 2 157 343, GB-A No. 2 029 049 or U.S. Pat. No. 4,033,890).

Any ionic groups present in the polymers may play a part in the build up of the toner charge. In general, however, the toner particles are charged by oil-soluble ionic compounds (controllers), for example by metal salts of organic acids containing long aliphatic radicals. Thus, carbon black pigments for example may be positively charged in liquid isoparaffin by organic phosphorus compounds (GB-A No. 1 151 141). A negative charge may be built up by addition of base metal alkylsulfonates (GB-A No. 1 571 401).

The disadvantage of using known charge-determining substances in combination with standard toner polymers is that the electrical properties of the liquid developers, such as conductivity and particle charge, are not stable in the event of changes in concentration and are influenced to a considerable extent by traces of water (for example atmospheric moisture). In addition, liquid developers of the type in question generally show high electrical conductivity of the dispersion medium which adversely affects the electrophoretic deposition of the toner particles.

It is known from DE-OS No. 3 232 062 and from the literature cited therein that the pigment particles of a suspension developer may be sterically stabilized by the creation of a crosslinked polymer shell by precipitation polymerization. This in itself considerably improves charge stability.

The object of the present invention is to provide an electrostatographic suspension developer with a further improved positive toner charge, high charge stability and low conductivity of the dispersion medium.

According to the invention, this object is achieved by the provision of an electrostatographic suspension developer which contains a dispersed pigment in an electrically insulating carrier liquid having a volume resistance of at least $10^9$ ohm.cm and a dielectric constant below 3 and which is characterized in that the pigment is coated with polycyanoacrylate.

In one preferred embodiment, the suspension developer contains a pigment with an inner shell of polycyanoacrylate and an additional shell of a copolymer of A. cationic monomers which contain ammonium, phosphonium or sulfonium groups and of which the anions are derived from CH-acid or sulfur- ior phosphorus-containing acid compounds containing at least one $C_6$–$C_{24}$ hydrocarbon radical and B. radically polymerizable, olefinically unsaturated compounds as comonomers.

The present invention also relates to a process for producing an electrostatographic suspension developer which is characterized in that a dispersed, basic or neutral pigment in an apolar carrier liquid is coated with polycyanoacrylate by anionic polymerization.

Hydrocarbons, fluorinated hydrocarbons or silicone oils may be used as the carrier liquid having a volume resistance of at least $10^9$ ohm.cm and a dielectric constant below 3. Preferred carrier liquids are liquids based on hydrocarbons, for example aromatic hydrocarbons, such as benzene, toluene or xylenes, or aliphatic $C_6$–$C_{15}$ hydrocarbons, such as n-hexane, cyclohexane, n-heptane, n-octane or decalin. Mixtures of different hydrocarbons may also be used. Branched aliphatic hydrocarbons, such as isodecane and isododecane, are particularly suitable.

Suitable pigments are the black and colored pigments normally used for suspension developers, providing they have neutral or basic surfaces. The suitability of a pigment may readily be determined by measuring the pH-value of a pigment-water suspension with a glass electrode. This method is described in detail, for example, in DIN 53 200. Suitable pigments show pH-values of from 6 to 12 and preferably of from 7 to 11. In many cases, it is possible to influence the pH-value, i.e. to adjust the desired pH value, by a preferably alkaline pretreatment of the pigment.

The water content of the pigments is another important factor in regard to their use in accordance with the invention. Pigments of low water content are generally used, pigments having a water content of less than 1% being preferred and those having a water content of less than 0.10% being particularly preferred.

Suitable black pigments are primarily basic carbon blacks. Carbon black having a primary particle size of from 20 to 80 nm, a BET surface of from 20 to 150 $m^2/g$ and a pH-value of from 8 to 10 is preferred. Suitable colored pigments without pretreatment are C.I. No. 74160, C.I. No. 45160 and C.I. No. 21100.

The pigments are preferably coated with cyanoacrylates corresponding to the following general formula

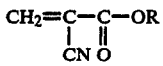

in which R represents an alkyl group, more especially a $C_1$–$C_{10}$ alkyl group, a cycloalkyl group, more especially a cyclohexyl group, an alkenyl group, more especially an allyl group, an aryl group, more especially a phenyl group, or an aralkyl group, more especially a benzyl group.

The above-mentioned substituents may in turn be substituted by any of the substituents normally encountered in the field of polycyanoacrylates, for example alkoxy groups, more especially methoxy and ethoxy groups. It is also possible to use different cyanoacrylates together to form corresponding copolymers.

Preferred examples of cyanoacrylates are ethyl, methyl, butyl, isobutyl, amyl and lauryl cyanoacrylate and also methoxyethyl cyanoacrylate and ethoxyethyl cyanoacrylate, isobutyl cyanoacrylate being particularly suitable. Another suitable cyanoacrylate is allyl cyanoacrylate which may be used either on its own or, advantageously, in admixture with the alkyl cyanoacrylates mentioned. Mixtures containing from 5 to 50% by weight of allyl cyanoacrylate are particularly favorable. The quantity of polycyanoacrylate amounts to between 2.5 and 350% by weight and preferably to between 10 and 250% by weight, based on the quantity of pigment.

In one particular embodiment, the pigment is coated with an additional shell of a copolymer of (A) cationic monomers and (B) radically polymerizable, olefinically unsaturated compounds. In this case, the copolymer generally acts as the charge-determining substance, i.e. it produces or strengthens the positive electrostatic charging of the coated pigment particles. The copolymer contains from 0.1 to 80, preferably from 0.5 to 50 and, more preferably, from 2 to 20% by weight of polymerized cationic monomers (A).

The cationic monomers contain onium groups, preferably ammonium, phosphonium or sulfonium groups. The negative counterions are derived from CH-acid or sulfur- or phosphorus-containing acid compounds containing at least one $C_6$–$C_{24}$ hydrocarbon radical.

The cation of the ionic monomers (A) preferably corresponds to one of the formulae I to III below:

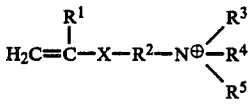

I

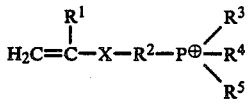

II

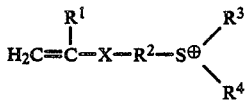

III in which $R^1$ represents a hydrogen atom or a $CH_3$ group, $R^2$ represents a $C_1$–$C_{18}$ hydrocarbon radical, $R^3$ and $R^4$ may be the same or different and represent a $C_1$–$C_{18}$ hydrocarbon radical; alternatively, $R^3$ and $R^4$ together form a 5- or 6-membered ring, $R^5$ represents a hydrogen atom or a $C_1$–$C_{18}$ hydrocarbon radical, X represents one of the groups

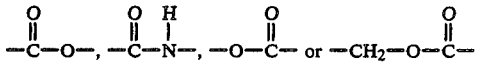

The hydrocarbon radicals mentioned may be linear or branched alkyl, aryl, arylalkyl or alkylaryl radicals which may be optionally be substituted.

Negative counterions derived from sulfur- or phosphorus-containing acid compounds preferably correspond to one of formulae IV to VIII below:

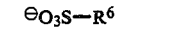

IV

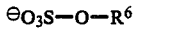

V

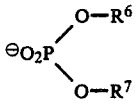

VI

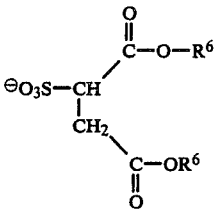

VII

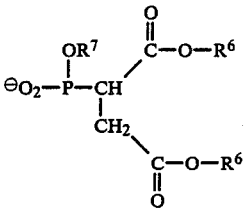

VIII in which $R^6$ is a $C_6$–$C_{24}$ hydrocarbon radical and $R^7$ is a $C_1$–$C_{18}$ hydrocarbon radical.

Preferred anions derived from CH-acid compounds correspond to formulae IX and X below

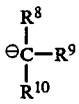

IX

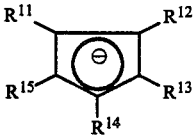

X in which $R^8$ represents one of the groups $—COOR^6$ or $—SO_2R^6$ where $R^6$ is a $C_6$–$C_{24}$ hydrocarbon radical, $R^9$ and $R^{10}$ may be the same or different and represent —CN, $—NH_2$, halogen, $—COOR^7$ or $—SO_2R^7$ where $R^7$ is a $C_1$–$C_{18}$ hydrocarbon radical, $R^{11}$ represents a $C_6$–$C_{24}$ hydrocarbon radical or —$COOR^6$,
$R^{12}$ represents one of the groups —CN or $COOR^7$ and
$R^{13}$, $R^{14}$ and $R^{15}$ may be the same or different and represent a hydrogen atom, the groups —CN, —$R^7$ or —$COOR^7$.
Examples of suitable cationic monomers are shown in Table I below:
TABLE I
Cationic monomers
| No. | formula |
|---|---|
| 1 | 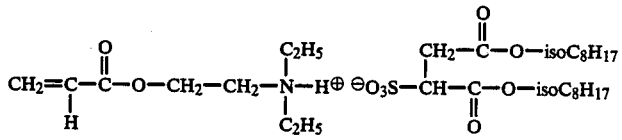 |
| 2 | 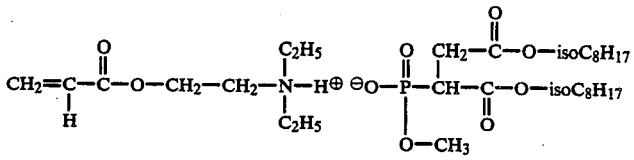 |
| 3 | 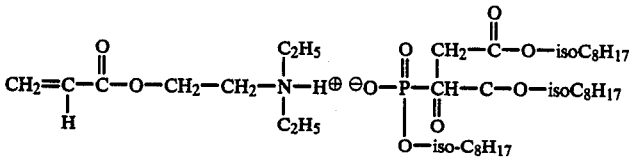 |
| 4 | 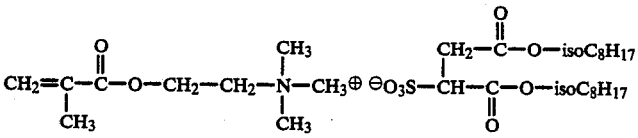 |
| 5 | 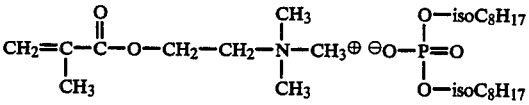 |
| 6 | 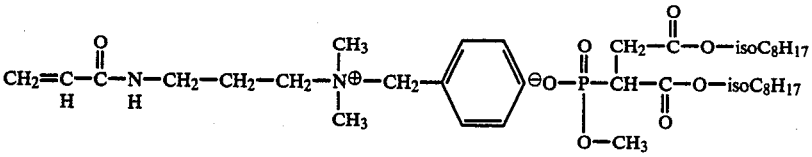 |
| 7 | 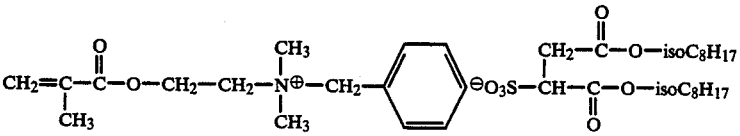 |
| 8 | 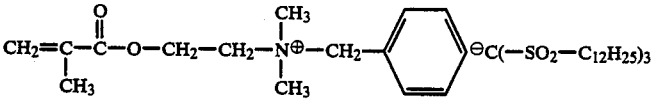 |
| 9 | 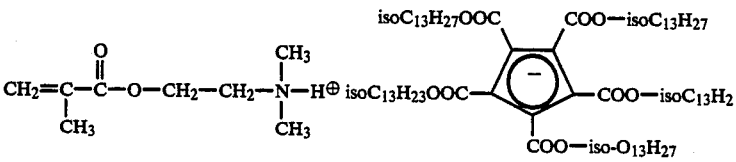 |

TABLE I-continued

| No. | formula |
|---|---|
| | Cationic monomers |
| 10 | 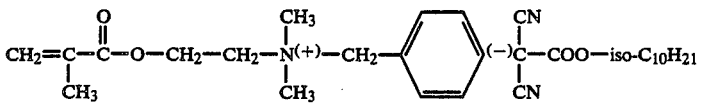 |

The cationic monomers described above may be directly used for forming the additional copolymer shell. However, it is also possible initially to prepare a copolymer using the basic monomers on which the cation part is based and then to introduce the positive charge by protonization or quaternization, optionally followed by anion exchange.

Suitable comonomers (B) are, in principle, any radically polymerizable, olefinically unsaturated compounds, more especially the known vinyl and vinylidene compounds. Examples of suitable comonomers (B) are (meth)acrylic acid and derivatives thereof such as, for example, (meth)acrylates containing $C_1$–$C_{24}$ hydrocarbon radicals in the alcohol portion, (meth)acrylamide, (meth)acrylonitrile, vinyl esters such as vinyl acetate, vinyl propionate, aromatic vinyl compounds such as styrene or α-methyl stylrene, also dienes such as butadiene and isoprene and halogen-containing monomers such as vinyl chloride and vinylidene chloride. Preferred comonomers are (meth)acrylates containing at least one $C_1$–$C_{24}$ hydrocarbon radical and styrene. Other suitable comonomers are mixtures of various monomers. Favorable incorporation rates are obtained above all when (meth)acrylates are at least partly used as comonomers. It is possible to synthesize both uncrosslinked copolymers and also copolymers crosslinked by using polyfunctional monomers such as, for example, ethylene dimethacrylate or divinyl benzene.

Improved dispersant properties may be imparted to the copolymer through the choice of the comonomers (B). In this case, the copolymer not only causes charging of the dispersed pigment coated with polycyanoacrylate, it also increases the dispersion stability of the pigment dispersion by steric screening. Comonomers which improve the dispersant properties of the copolymer are, for example, vinyl or vinylidene monomers containing a $C_6$–$C_{24}$ hydrocarbon radical, more especially (meth)acrylates containing $C_6$–$C_{24}$ hydrocarbon radicals, for example stearyl methacrylate, lauryl methacrylate or 2-ethylhexyl methacrylate, these comonomers preferably being used in quantities of from 10 to 70% by weight, based on copolymer. In this case, the comonomers mentioned here are advantageously combined with those containing $C_1$–$C_5$ hydrocarbon radicals.

However, improved dispersant properties of the comonomer are not characteristic of the present invention. Dispersion stability may readily be established by other polymeric additives, as explained hereinafter.

To prepare the suspension developer according to the invention, the basic or neutral pigment is dispersed in an apolar solvent. Suitable solvents are the liquids mentioned above as carrier liquids. The solvents are thoroughly dried before use. The pigment concentration should preferably be from 0.1 to 40% by weight. It is best to use a dispersion aid when preparing the dispersion.

Suitable dispersion aids are soluble compounds of high molecular weight, such as homopolymers or copolymers of (meth)acrylates, for example a 1:1-copolymer of isobutyl methacrylate and lauryl methacrylate. Other suitable dispersion aids are copolymers containing from 0.1 to 15% by weight of copolymerized monomers containing OH groups, such as for example 2-hydroxyethyl methacrylate.

Particularly suitable dispersion aids are block copolymers such as, for example, styrene-stearyl methacrylate block copolymers or mercaptan-modified styrene-butadiene block copolymers (DE-A No. 34 12 085).

The pigment is coated by addition of the monomeric cyanoacrylates, preferably using an inflow process, for example over a period of from 10 to 120 minutes. The anionic polymerization takes place under the catalytic effect of the pigment and leads after short reaction times to high polymer conversions, generally of more than 70%, the polymer formed being formed as a shell on the surface of the pigment. Although the polymerization temperature is not critical, the temperature range of 0° to 80° C. is preferred for practical reasons.

The known controllers may be used for regulating the electrical charge of the pigment particles coated with polycyanoacrylate. They include, for example, oil-soluble ionic compounds, such as for example metal salts of long-chain organic acids. It is also possible to use mixtures of different controllers, for example a mixture of different controllers having opposite charge effects, so that the strength of the charge on the toner or its polarity may be adjusted by altering the ratio in which the two controllers are mixed (GB-PS No. 1 411 287, GB-PS No. 1 411 537 and GB-PS No. 1 411 739). Particularly suitable, positively working controllers are described in GB-PS No. 1 151 141. These controllers are divalent or trivalent metal salts of a phosphorus-based oxy acid containing an organic radical.

In one preferred embodiment of the present invention, the positive charging of the pigment particles is caused or strengthened by application of an additional shell of a copolymer of the above-described cationic monomers A and comonomers B. This additional polymer shell is applied by a radical polymerization process in which the monomer A or rather the basic monomer on which the cationic monomer A is baded on comonomers B and also a free radical former as initiating component are added to the dispersion of the pigment coated with polycyanoacrylate and the polymerization is carried out at a temperature of preferably 50° to 120° C. to conversions of at least 70%.

Suitable free radical formers are the known per compounds and, preferably, azo compounds. The monomers and radical formers are preferably introduced by an inflow process.

The coated pigment particles have an average particle size of from 0.1 to 2 μm. The dispersion obtained by the present process may be diluted to the desired working concentration, for example to 0.01 to 1%, by the addition of more solvent as carrier liquid. At the same time, it is possible if desired to replace existing solvent by another carrier liquid, for example by centrifuging and subsequent redispersion. In addition to polycyanoacrylate and the described copolymer of monomers A and B, other polymeric additives may be used in the preparation of the suspension developer according to the invention, for example to increase dispersion stability or to improve the adhesion or fixing properties of the dispersed pigment.

The dispersion aids mentioned earlier on based on soluble compounds of high molecular weight are particularly suitable for increasing dispersion stability.

Suitable fixing agents are resins which are compatible with the binder of the recording material so that firm adhesion of the image produced to the substrate is obtained after development. Examples of suitable resins are esters of hydrogenated rosin and long oil, rosin-modified phenol-formaldehyde resin, pentaerythritol esters of rosin, glycerol esters of hydrogenated rosin, ethyl cellulose, various alkyd resins, poly(meth)acrylate resin, polystyrene, polyketone resin and polyvinyl acetate. Specific examples of resins such as these can be found in the literature on electrostatographic suspension developers, for example in BE-PS No. 699 157 and in GB-A No. 1 151 141.

The preparation of suspension developers according to the invention is described in detail in the following Examples:

EXAMPLE 1

A. Synthesis iof a dispersion aid 1000 ml of cyclohexane, 5 ml of glycol dimethylether and 50 g of styrene are introduced in the absence of water and oxygen into a 2-liter glass autoclave. The mixture is carefully titrated with a 1-molar n-butyl lithium solution in n-hexane until it turns pale yellow in color. 3 ml of the 1-molar butyl lithium solution are then added. The polymerization temperature is kept at 40° C. by external cooling. After a reaction time of 60 minutes, 50 g of butadiene are added and the mixture is polymerized for 60 minutes at 50° C. Thereafter the conversion is complete. 48 ml of n-dodecyl mercaptan and 0.5 g of azodiisobutyronitrile are then added, followed by heating for 5 hours to 80° C. After cooling to room temperature, the block copolymer is precipitated from the cyclohexane solution with 2000 ml of ethanol, to which 2 g of 2,6-di-tert.-butyl-p-methylphenol have been added, and dried in vacuo to constant weight. 140 g of a colorless block copolymer are obtained. $[\eta]=0.272$ dl/g, toluene, 25° C.; 4.5% by weight sulfur in the polymer.

B. Preparation of a pigment dispersion 40 g of carbon black pigment having a particle size of 50 nm, a BET surface of 30 $m^2/g$ and a pH value according to DIN 53 200 of 8.5, 8 g of the dispersion aid A and 152 g of dried isododecane are mixed for 16 hours in a steel ball mill in the absence of moisture, a stable dispersion being formed.

C. Coating of the dispersed pigment with polycyanoacrylate

Quantities of 100 g of the dispersion B are transferred in the absence of moisture to a stirrer-equipped reactor. 10, 20 and 40 g of isobutyl cyanoacrylate are added dropwise with stirring at room temperature over a period of 30 minutes. After the addition, the mixture is stirred for 2 hours. For analysis purposes, coated pigment is isolated by centrifuging and purified by washing with isododecane. The conversion is determined by N-analysis.

| Isobutyl methacrylate | Conversion | Diameter [nm]* |
|---|---|---|
| 50% (based on pigment) | 88.6% | 398 |
| 100% (based on pigment) | 94.0% | 423 |
| 200% (based on pigment) | 93.0% | 495 |

*as measured by laser scattered-light spectroscopy

D. Suspension developer

After dilution of the dispersion to a solids content of 4% by weight, 5 mg of zinc mono-(2-butyl)-octylphosphate were added per gram of solids.

The suspension developer showed very good stability in storage. Particle size and conductivity were unchanged after storage for 6 months.

EXAMPLE 2

Suspension developer according to the invention 100 g of the pigment dispersion of Example 1B were transferred to a stirrer-equipped reactor in the absence of moisture. A solution of 36 g of isobutyl cyanoacrylate, 4 g of allyl cyanoacrylate and 50 g of isododecane was added dropwise with thorough stirring over a period of 30 minutes at room temperature. The temperature is then increased to 80° C. and 400 mg of azoisobutyrodinitrile are added. A solution of 10 g of N,N-dimethylaminoethyl methacrylate, 5 g of styrene, 5 g of butyl acrylate, 40 g of toluene and 40 g of isododecane is then introduced while purging with nitrogen. After the addition, the reaction mixture is stirred for 2 hours at 80° C. and for another 2 hours at 90° C. The solids are isolated by centrifuging (30 mins./2000 r.p.m.), washed with isododecane and dispersed in pure isododecane using ultrasound to form a 1% dispersion. Particle size: 303 nm.

Different quantities of pentaisotridecyloxycarbonyl cyclopentadiene (PTDCCP) are added as controller to this dispersion.

| Suspension developer | Quantity of PTDCCP used (%), based on solids | Conductivity of the developer [$ohm^{-1}$ $cm^{-1}$] |
|---|---|---|
| A | 0.5 | $1.6 \times 10^{-10}$ |
| B | 1 | $3 \times 10^{-10}$ |
| C | 2 | $8 \times 10^{-10}$ |

Suspension developers A, B and C show a positive toner charge. They have excellent developer properties. Conductivity and particle size do not change in storage.

We claim:

1. An electrostatographic suspension developer containing a dispersed pigment in an electrically insulating carrier liquid having a volume resistance of at least $10^9$ ohm.cm and a dielectric constant below 3, having a pigment with a coating comprised of an inner shell of polycyanoacrylate and an additional shell of a copolymer of A. cationic monomers which contain ammonium, phosphonium or sulfonium groups and of which the anions are derived from CH-acid compounds containing at least one $C_6$–$C_{24}$ hydrocarbon radical and B. radically polymerizable olefinically unsaturated compounds as comonomers.

2. An electrostatographic suspension developer as claimed in claim 1, characterized in that a cyanoacrylate corresponding to the following formula

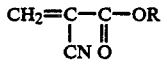

in which R represents alkyl, cycloalkyl, alkenyl, aryl and aralkyl, is used for coating.

3. An electrostatographic suspension developer as claimed in claim 1, characterized in that the pigment is coated with alkyl and allyl cyanoacrylates.

4. An electrostatographic suspension developer as claimed in claim 2, characterized in that the cyanoacrylate is methyl, ethyl, butyl, isobutyl, amyl, lauryl or allyl cyanoacrylate.

5. An electrostatographic suspension developer as claimed in claim 1, characterized in that the quantity of polycyanoacrylate, based on the quantity of pigment, amounts to between 2.5 and 350% by weight.

6. An electrostatographic suspension developer as claimed in claim 1, characterized in that the quantity of polycyanoacrylate, based on the quantity of pigment, amounts to between 10 and 250% by weight.

* * * * *